US006173515B1

(12) United States Patent
Walsh

(10) Patent No.: US 6,173,515 B1
(45) Date of Patent: Jan. 16, 2001

(54) DIORAMA CARD WITH POP-UP

(75) Inventor: Stacy A. Walsh, 40 Linnaean St., #10, Cambridge, MA (US) 02138

(73) Assignee: Stacy A. Walsh, Cambridge, MA (US)

( * ) Notice: Under 35 U.S.C. 154(b), the term of this patent shall be extended for 0 days.

(21) Appl. No.: 09/484,326

(22) Filed: Jan. 18, 2000

(51) Int. Cl.[7] ..... G09F 1/00

(52) U.S. Cl. ..... 40/124.08; 40/124.07; 229/128

(58) Field of Search ..... 40/124.07, 124.08, 40/539, 738, 743; 229/116.1, 128

(56) References Cited

U.S. PATENT DOCUMENTS

| | | | | |
|---|---|---|---|---|
| 956,916 | * | 5/1910 | Wiederseim, Jr. | 40/124.07 |
| 1,555,566 | * | 9/1925 | Furste | 40/124.07 |
| 4,887,709 | * | 12/1989 | Shimamine | 229/128 |
| 5,061,501 | * | 10/1991 | Lowe | 229/128 |

* cited by examiner

*Primary Examiner*—Cassandra H. Davis

(57) ABSTRACT

A three dimensional diorama card assembled, stored and shipped in a substantially flat form, constructed of a first blank having a front panel in which an opening is cut, a back panel to form the back of the card, and a tab to facilitate the construction of the card. A second blank of the card has a panel which forms the background of the scene. Extending from the top and bottom of the background panel are pinched elliptical panels which form the structural support for the erected of the card as well as the inside top and bottom, respectively, of the scene. A pop up member is formed from the second blank. The back of the second blank is secured to the back panel of the first blank. An image blank is also secured to the pop up member. The front panel of the second blank is folded over the second blank and the tab is secured to the back of the second panel. In operation, the sides of the card are squeezed, causing the front panel to bow outwardly and the back panel together with the background panel to bow outwardly in the other direction. The elliptical panels, due to the curved fold line scoring between each ellipse and the background panel, extend forwardly into the newly created space between the front panel and the background panel and engage the inside of the front panel to provide structural stability for the erect card. Also, when the sides of the card are squeezed, the pop up support extends forwardly, bearing with it the image blank. In its erect state, the card produces a three dimensional scene visible through the opening in the front panel featuring the image blank in front of the background panel.

7 Claims, 6 Drawing Sheets

DIORAMA CARD WITH POP-UP

BACKGROUND OF THE INVENTION

The invention is a card that can be used as a greeting card, souvenir, gift item, or display for information, advertising and the like. More particularly, the card of the invention is assembled, shipped and stored in a flat form. Upon a simple manual operation, the card takes on a three dimensional shape to form a diorama. The erected card has an opening through which a scene comprising an image in front of a background is viewed.

SUMMARY OF THE INVENTION

The invention relates in general to a diorama card. The card is shipped and stored flat. The card is erected by a simple manual operation. The card is constructed of die cut blanks made from a thin foldable and flexible material such as cardboard, paper, or plastic sheet material. The flat storage and shipping of the card as well as the possible use of common and readily available materials makes the invention inexpensive to manufacture, ship, and store and therefore available at a low cost.

The card is constructed of a first blank having a front panel in which an opening is cut, a back panel to form the back of the card, and a tab to facilitate the construction of the card. The viewing window may be of any shape. The opening may also include a transparent or semitransparent material to further add visual effects.

The second blank of the card has a panel which forms the background of the scene. The background may be plain or it may be illustrated. Extending from the top and bottom of the background panel are pinched elliptical panels which form the structural support for the card in its erect state as well as the inside top and bottom, respectively, of the scene. Cut and fold lines at the bottom of the background panel of the second blank bridging the bottom ellipse panel form a pop up support for an image blank.

The back of the second blank is secured by means of an adhesive or the like to the back panel of the first blank. An image blank is also secured by means of an adhesive or the like to the vertical section of the pop up support.

The front panel of the first blank is folded over the second blank and the tab is secured by means of an adhesive or the like to the back of the second panel.

In general, the background panel and the elliptical panels feature an appropriate illustration and may also feature a text message. For example, the bottom elliptical panel may feature an illustration of grass, the background panel an image of grassy rolling hills and sky, the top ellipse sky, and a text message printed on the background panel such as "Thank you." The image blank may be any image, for example an image of a bouquet of flowers in a vase. It may also feature text.

In operation, the sides of the card are squeezed, causing the front panel to bow outwardly and the back panel together with the background panel to bow outwardly. The elliptical panels of the second blank, due to the scored fold line between each elliptical panel and the background panel, extend downwardly and forwardly into the newly created space between the front panel and the background panel to provide structural stability to the card as well as to form their respective aspects of the scene. Also, when the sides of the card are squeezed, the pop up support extends upwardly and forwardly, bearing with it the image blank. Thus, in its erect state, the card produces a three dimensional scene or diorama in which through the window the image blank is viewed against a background.

The choice of materials, coloration, texture and illustrations of the various components are extensively variable.

OBJECTS OF THE INVENTION

It is an object of the invention to provide a three dimensional or diorama card.

It is a further object of the invention to provide a three dimensional card featuring a window, a foreground image, and a background image.

It is a further object of the invention to provide a three dimensional card featuring a window, a foreground image, a background image and a bottom background image.

It is a further object of the invention to provide a three dimensional card featuring a window, a foreground image, a background image, a bottom background image, and a top background image.

It is a further object of the invention to provide a three dimensional card that may be simply constructed of inexpensive materials.

It is a further object of the invention to provide a three dimensional card that is assembled stored and shipped in a flat state.

It is a further object of the invention to provide a card that may be simply manipulated from a flat state to a three dimensional state.

Other objects and advantages of the invention will be apparent from the following detailed description taken in conjunction with the accompanying drawings wherein a preferred embodiment is described with reference to the drawings.

BRIEF DESCRIPTION OF THE DRAWINGS

For a more complete understanding of the invention, reference is made to the accompanying drawings, in which, for the preferred embodiment of the invention.

DETAILED DESCRIPTION OF THE PREFERRED EMBODIMENT

Figure 1:
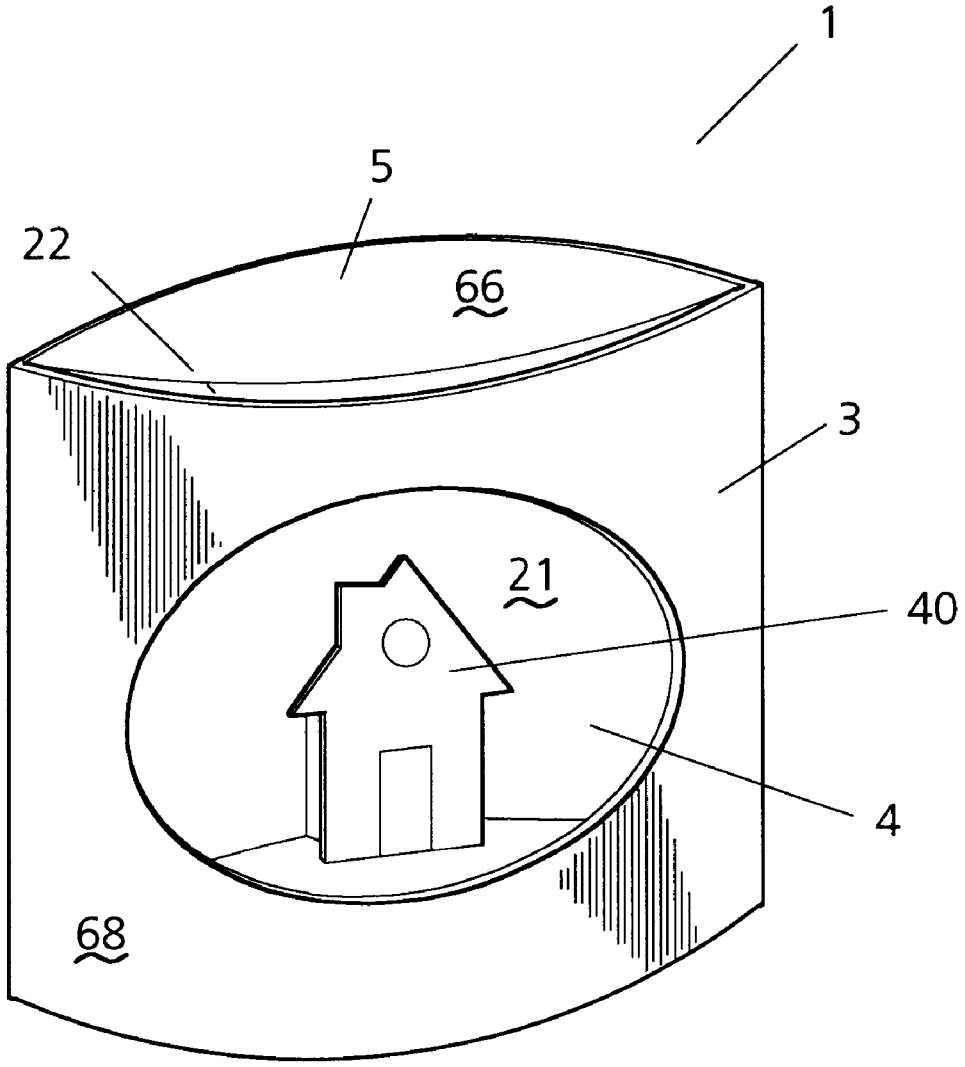
FIG. 1 is a front perspective view of the card in its erect state.
Figure 5:
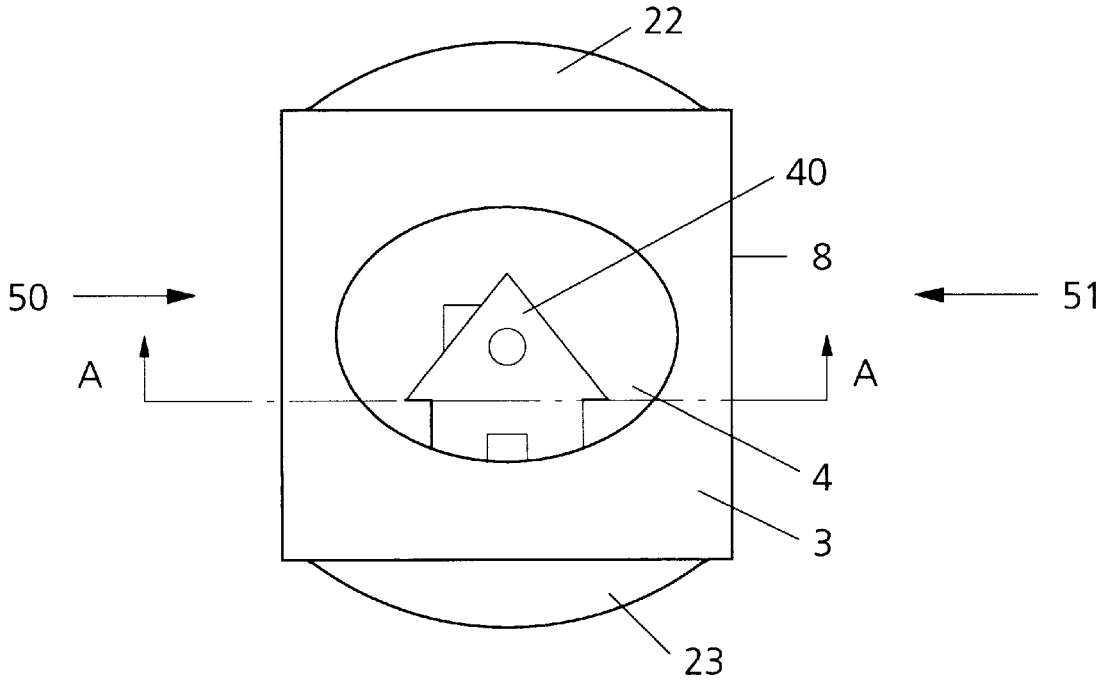
FIG. 5 is a front plan view of the assembled card.

FIG. 1 shows a card 1 of the present invention in a display or operable position. FIG. 5 shows the card 1 in a flat or shipped position. The card 1 generally comprises a first blank 2 disposed or contained within a second blank 20. Front panel 3 curves outwardly and features an opening 4 through which a scene comprising an image blank 40 is viewed in front of a background panel 21 which is also curved outwardly in the opposite direction of the front panel. Elliptical top panel 22 forms part of the structural support for the card 1 in its displayed state.

Figure 2:
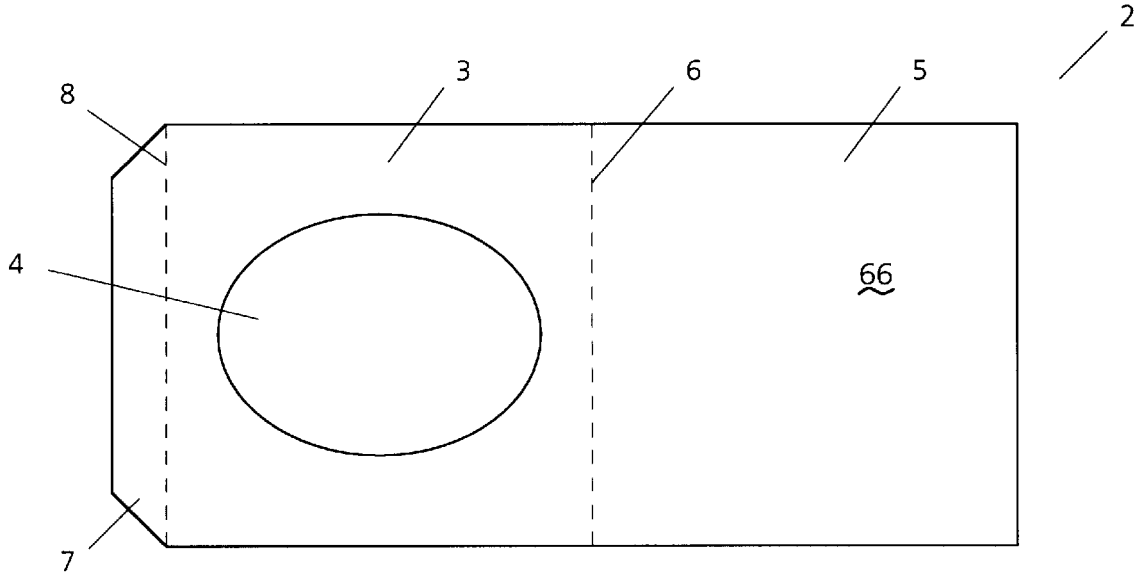
FIG. 2 is a plan view of the inside (or back) of the first blank of the card.

FIG. 2 is a plan view of the first blank 2. The first blank 2 may be constructed of a wide variety of materials such a paper stock of suitable thickness, card board, plastic stock, thick film stock and the like. The materials may be colored, illustrated or feature textures. Further, first blank 2 may be constructed of a unitary material, or the individual panels may be constructed to form the blank. First blank 2 includes a front panel 3 in which opening 4 is cut. Opening 4 may be of any shape and may also feature additional detail such as window light details or lower super foreground detail. Opening 4 may also be covered over with a transparent or semi-transparent material so as to provide a further visual feature such as color or frosting. First blank 2 also has a back panel 5 having an inside surface 66 and an outside surface 68 and extending from the side thereof which serves as the back of the assembled and erected card 1. Back panel 5 and front panel 3 are separated from front panel 3 by a fold line 6. A tab 7 extends from the other side of front panel 3, separated from front panel 3 by a fold line 8. In order to reduce the precision necessary to assemble the card of the invention, angled cuts may be provided at the top and bottom of tab 7.

Figure 3:
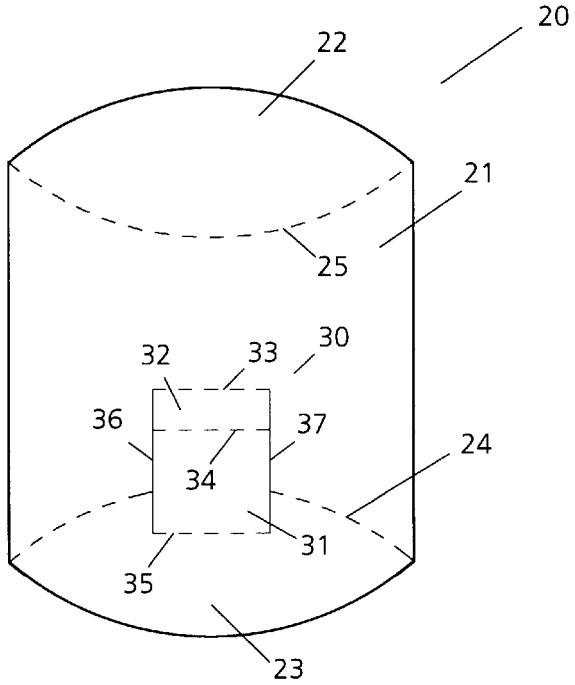
FIG. 3 is a front plan view of the second blank of the card.

FIG. 3 is a front plan view of the second blank 20. The second blank 20 may also be constructed of a wide range of materials in the same manner as first blank 2. The top of second blank 20 includes a top panel 22, a background panel 21, and a bottom panel 23. The top panel 22 and bottom panel 23 may take a variety of different shapes. By way of example only, the top panel 22 and the bottom panel 23 may be of elliptical shape. The top panel 22 and bottom panel 23 are separated from background panel 21 by scored fold lines 25 and 24, respectively. The vertical dimension (in the flat position of FIG. 3) of the elliptical top and bottom panels 22 and 23 determine the depth of the scene; a longer vertical dimension provides a deeper scene. The scored fold lines 25 and 24 substantially mirror the opposing distal curved side of the top and bottom panels 22 and 23.

The front of elliptical top panel 22 may be illustrated to form part of the scene, for example as sky or ceiling. The front of ellipse bottom panel 23 may be illustrated to form part of the scene, for example as ground or floor. The front surface of the background panel 21 may be illustrated to form the background for the scene of card 1. The second blank 20 further comprises a pop-up support 30 having a vertical front panel 31 and a horizontal top panel 32. Pop up support 30 is formed from and bridges part of background panel 21 and the elliptical bottom panel 23. A scored fold line 33 is provided between the top of top panel 32 and background panel 21. A scored fold line 34 is provided between horizontal top panel 32 and front panel 31. A scored fold line 35 is provided between vertical front panel 31 and ellipse bottom panel 23. Vertical cuts 36 and 37 allow the pop-up support 30 to separate from second blank 20 when the card 1 is operated to the displayed position. The width of the pop-up support 30 is selected so as to adequately support the image blank 40 but generally not seen behind the image blank 40. In an alternate embodiment of the invention, the pop-up support 30 may form a part of the image blank 40 and may be appropriately illustrated, for example as a table. In another alternate embodiment of the invention, the pop-up support 30 may be constructed to have a series of steps and therefore multiple front panels and top panels to allow for more than one image blank to be positioned and secured thereon. In yet another alternate embodiment of the invention, multiple pop-up supports 30 can be provided.

The vertical dimensions (in the flat configuration) as well as the placement of horizontal top panel 32 depends on the desired relative distance of image blank 40 from background panel 21 and front panel 3. The shorter the vertical dimension of top horizontal panel 32, the closer image blank 40 will be to background panel 21, and vice versa. The vertical dimensions (in the flat configuration) as well as the placement of vertical front 31 depends on the desired relative height of foreground image 40 in the scene for card 1. The shorter the vertical dimension of vertical front panel 31, the lower foreground image 40 appears in the scene, and vice versa.

Figure 4A:
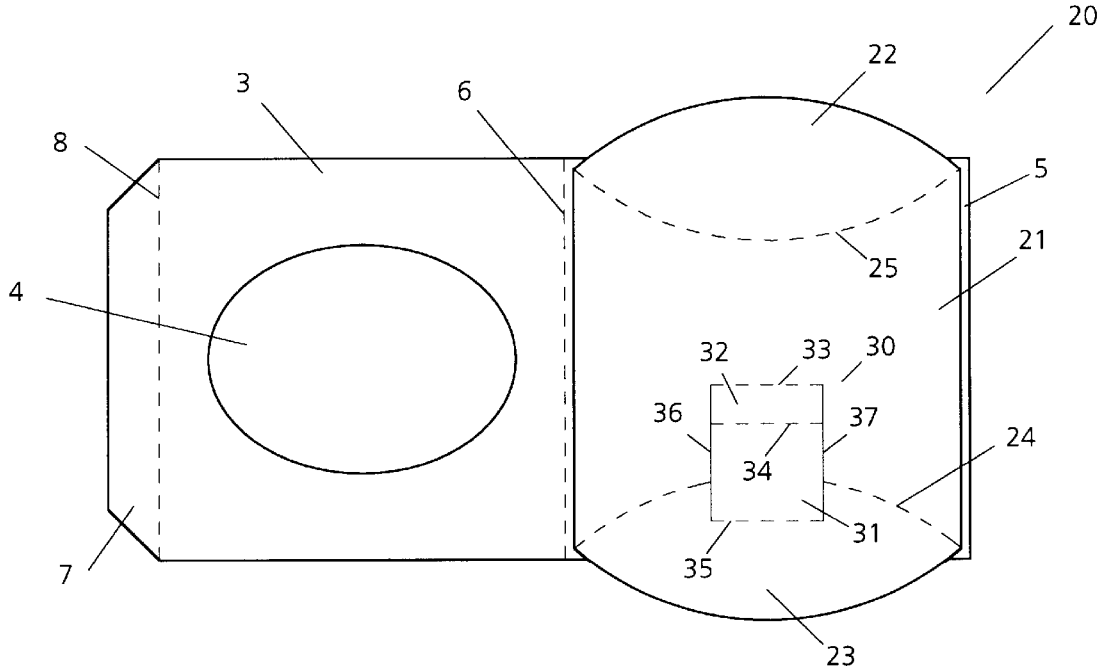
FIG. 4*a* is a front plan view of the second blank in position relative to the first blank in the manufacture of the card.

FIG. 4*a* illustrates the front plan view of second blank 20 positioned on back panel 5 of first blank 1. Blanks 2 and 20 may be secured together in any manner suitable for the materials selected. For example, for cardboard stock, glue, adhesive tape, or staples may be used. It is important that the means for securing second blank 20 is only applied to the back of the background panel 21 and not to the back of elliptical top and bottom panels 22 and 23 in order to allow the elliptical panels to move when card 1 is operated to erect it. Suitable spacing between fold line 6 of first blank 2 and the side of second blank 20 is provided to allow front panel 3 to be folded over without binding.

Figure 4B:
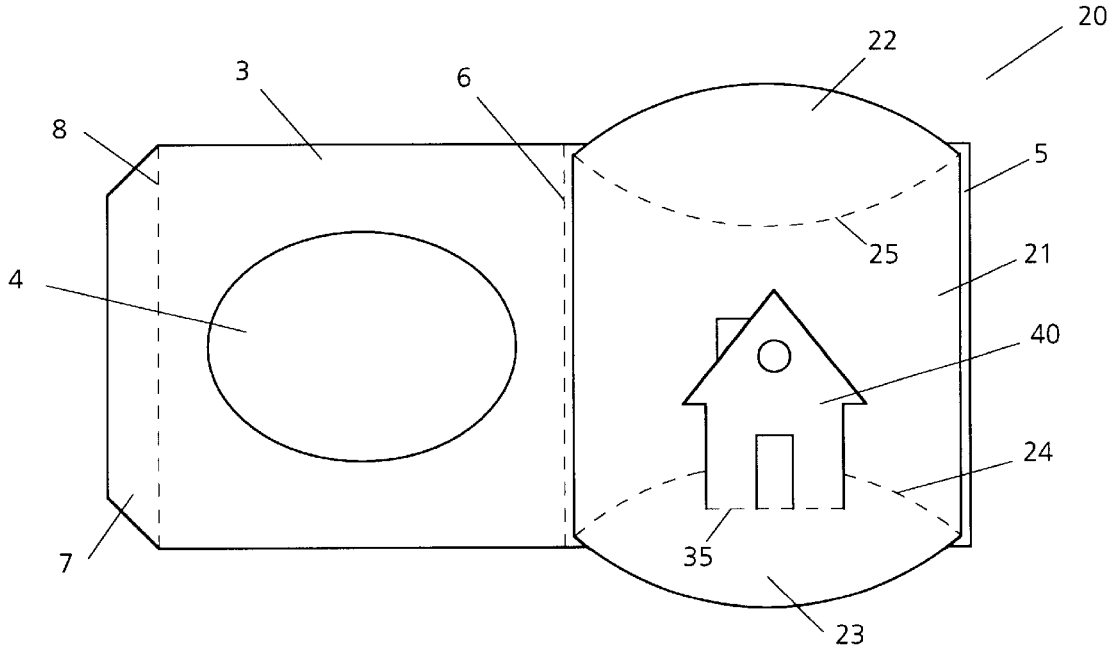
FIG. 4*b* is a front plan view of the second blank in position relative to the first blank and the image blank in place.

Image blank 40 may be constructed of a wide range of materials including but not limited to cardboard stock, paper and plastic. Image blank 40 is positioned and secured to vertical front panel 31 of pop up support 30 as shown in FIG. 4*b* by any means suitable for the materials selected. In an alternative embodiment of the invention a hole may be provided in image blank 40 and a corresponding hole in vertical front panel 31 of pop up support 30. Through such corresponding holes a fastener may be used such that image blank 40 may rotate about the axis of the fastener. In another embodiment of the invention, image blank 40 may be a compressible three dimensional form, constructed for example of foam rubber or the like. In this embodiment, card 1 may be assembled, stored and shipped flat, and when card 1 is erected, image blank 40 will expand to its uncompressed state.

In another alternate embodiment of the invention, image blank 40 may be a panel formed from and by cuts in background panel 21 and bottom panel 23 and a scored fold line at the bottom of the image panel. In this case, background panel 21 and bottom panel 23 would have a opening corresponding to the shape of the image panel, but this opening may be hidden by the image panel so as to not detract from the scene or, the inside of back panel 5 may be illustrated to match and correlate to the illustration on background panel 21 to camouflage the opening left by the portion of background panel 21 and bottom panel 23 serving as the image panel.

In an alternate embodiment of the invention, multiple image panels or image blanks 40 are provided, secured to multiple top or front panels of pop up support 30, positioned on side by side pop up supports. Image panels may also enter the scene from the top rather than or in addition to from the bottom, secured to pop up supports 30 extending from background panel 21 and top panel 22. In another alternate embodiment of the invention, image blank 40 and/or pop up support 30 are provided with a means to allow a photograph, business card or such other otherwise existing article to be secured thereto. In a further alternate embodiment of the invention, any of the blanks or panels may be constructed of transparent or semi-transparent material so as to create additional lighting and visual effects. In yet another alternate embodiment of the invention, any of the blanks or panels may have openings therethrough which do not interfere with the structure and operation of card 1 for lighting, visual and structural effect.

Figure 6:
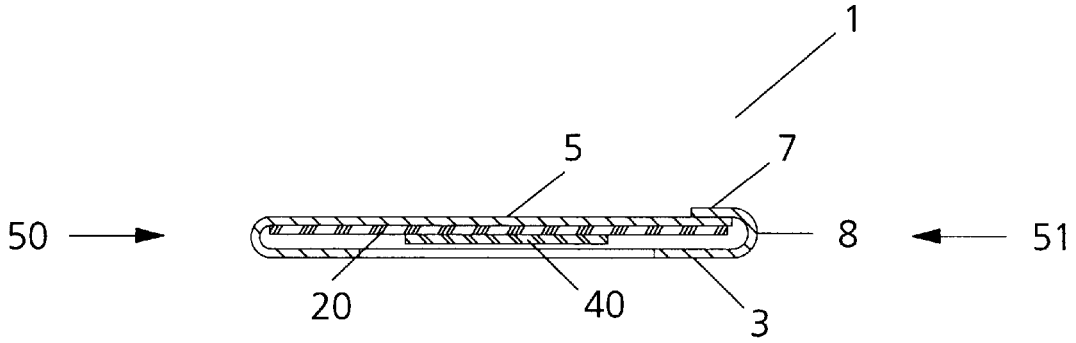
FIG. 6 is a cross section of the front panel and tab of the first blank folded over the second blank and back panel of the first blank taken at line A—A in FIG. 5.

To complete the assembly of card 1, front panel 3 of first blank 2 is folded over the front of second blank 20 along fold line 6, and tab 7 of first blank 2 is folded over the back of second blank 20 and back panel 5 along fold line 8. Tab 7 is secured to the back of back panel 5 by means suitable for the materials selected for the blanks. In the case where cardboard is employed, glue or adhesive tape may be used. FIG. 5 is a front plan view of assembled card 1 and FIG. 6 is a section view of assembled card 1 taken along line A—A in FIG. 5. It is in this substantially flat configuration that card 1 may be stored and shipped.

Figure 7:
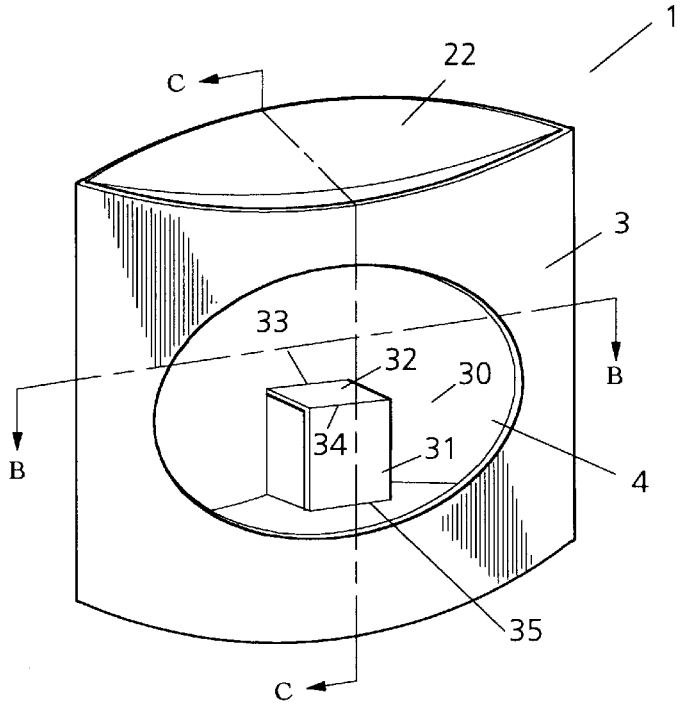
FIG. 7 is front perspective view of the erected card without the image blank in place in order to show the pop up support in its erected state.
Figure 8:
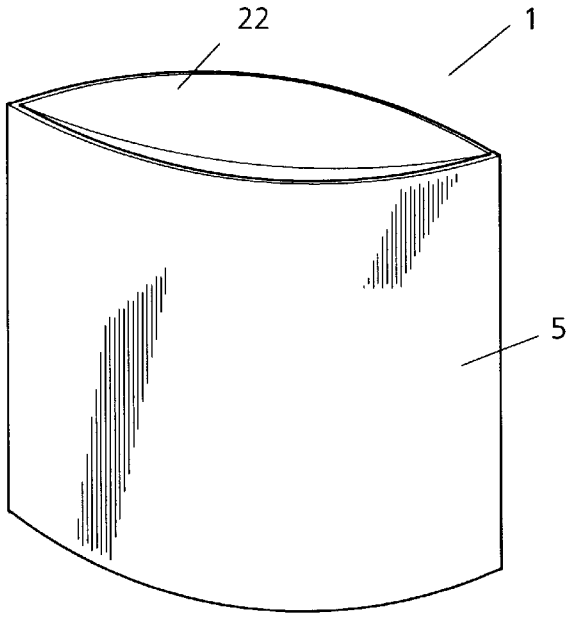
FIG. 8 is a back perspective view of the erected card.
Figure 9:
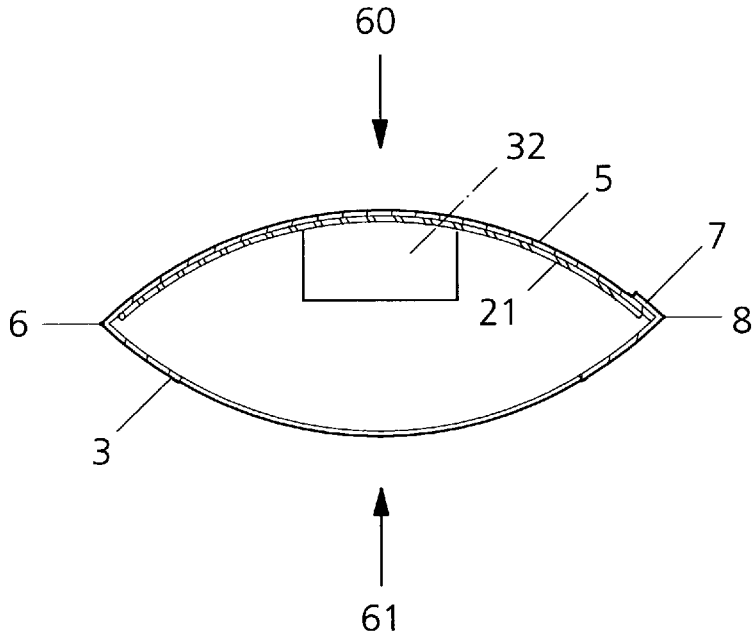
FIG. 9 is a cross section of the erected card taken at line B—B in FIG. 7.
Figure 10:
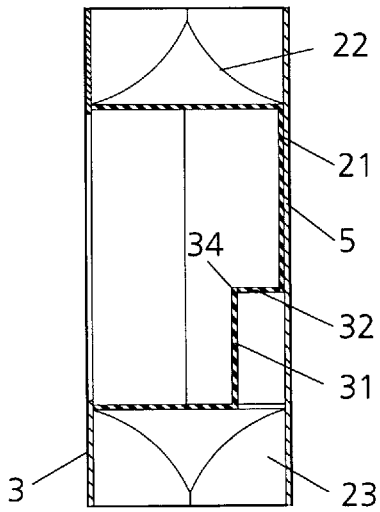
FIG. 10 is a section view of the erected card taken at line C—C in FIG. 7

To erect the card 1 to the display position, the sides of the flat assembly shown in FIG. 5 are squeezed by a person, user or operator, as indicated generally by directional arrows 50 and 51. The squeezing action causes front panel 3 to bow or move outwardly and the combination of back panel 5 and background panel 21 to bow or move outwardly. The shortening of the width of the overall assembly of card 1 works with: the curve of fold line 25 to cause elliptical top panel 22 to fold downwardly (forming a concave top surface in top panel 22) along fold line 25; and the curve of fold line 24 to cause elliptical bottom panel 23 to fold upwardly (forming a concave bottom surface in bottom panel 23) along fold line 24. Both the distal edge of elliptical top panel 22 and the distal edge of elliptical bottom panel 23 engage the inside of front panel 3, ideally perpendicular as shown in FIG. 10 which is a section view of erect card 1 taken at line C—C in FIG. 7, but less than perpendicular will generally suffice. Elliptical panels 22 and 23 thereby form the structural support for the three dimensional card and hold front panel 3 and background panel 21 together with back panel 5 in their outwardly bowed state. The outwardly bowed back panel 5 is shown in FIG. 8. As shown in FIG. 9, a top plan view of erect card 1, front panel 3 and background panel 21 together with back panel 5 thereby take the shape of elliptical top and bottom panels 22 and 23.

When elliptical bottom panel 23 moves upwardly, it pulls along the bottom of vertical front panel 31 of pop up support 30 and causes: a fold along fold line 35; a fold along line fold line 34; and, a fold along fold line 33. The angles between elliptical bottom panel 23 and vertical front panel 31, vertical front panel 31 and horizontal top panel 32, and horizontal top panel 32 and background panel 21 when card 1 is in its erect state are determined by the lengths selected for vertical front panel 31 and horizontal top panel 32 as well as the angle established by elliptical bottom panel 23 and front panel 3. Optimally, such angles approximate ninety degrees, but variations are acceptable and may be desirable in alternative embodiments. In the preferred embodiment of the invention, front panel 31 is substantially vertical and top panel 32 is substantially horizontal, as shown in the section view of FIG. 10.

Image blank 40 is, as previously noted, secured to vertical front panel 31, and therefore, as card 1 is erected, image blank 40 moves upwardly and forwardly in the space created between the inside of front panel 3 and background panel 21. In an alternative embodiment, where for example image blank 40 features an illustration of an airplane or balloon, the orientation of the illustrations and text on the various components can be flipped so that image blank 40 moves downwardly and hangs downwardly in the scene rather than extending upwardly into the scene.

In the preferred embodiment, as shown in FIG. 1, image blank 40 is disposed in the space formed by the bow of front panel 3 and background panel 21 and is visible through opening 4. Image blank 40 may be considered and illustrated as a foreground image in the scene when front panel 3 about opening 4 acts as a proscenium or, when front panel 3 is illustrated or constructed as part of the foreground, as an image between the foreground and the background. The bottom of elliptical top panel 22 forms the top of the scene and the top of elliptical panel 23 forms the bottom of the scene. The bottom edge of bowed front panel 3 and the bottom edge of bowed back panel 5 form a base upon which erect card 1 may stand on a surface. Erect card 1 may be returned to its flat configuration by gently squeezing at points as generally indicated by directional arrows 60 and 61 in FIG. 9. In the case where the engagement of the distal edges of elliptical panels 22 and 23 with the inside of front panel 3 prevents such gentle pressure to collapse erect card 1, the bottom of elliptical panel 22 may be pushed up and the top of elliptical panel 23 may be pushed down to effectuate collapse and return of card 1 to its flat state.

Although the card 1 has been described with reference to the first blank 2 and the second blank 20, the first blank 2 and second blank 20 may be made from a single blank.

The foregoing describes and illustrates the structure and function of the preferred embodiment, with occasional reference to alternative embodiments. It is understood that the invention is capable of modification and therefore the invention is not limited to the precise details set forth in the description and illustrations.

What is claimed is:

1. An article comprising:

(a) a background panel;

(b) a front panel foldable upon said background panel to form first and second side portions:

an image member engaged with said background panel; and (d) when said first and second side portions of the article are squeezed said front panel and said background panel bow outwardly to display position where a display space is created between said front panel and background panel and said image member is disposed in said space and is visible through an opening of said front panel (e) a first blank member and a second blank member, said first blank member having said front panel and said back panel formed therein and a second blank member having said background panel formed therein.

2. The article of claim 1, further comprising a pop-up member adapted to project said image member forward between said front panel and said background panel when said first and second side portions of the second blank member are squeezed.

3. The article of claim 2, wherein said pop-up member is engaged with said second blank member and said image member is engaged to said pop-up member.

4. The article of claim 3, wherein said first blank member further comprises a back panel, said background panel being engaged to said back panel.

5. The article of claim 1, wherein said second blank member further comprises a first panel portion which folds inward when said first and second side portions of the article are squeezed.

6. The article of claim 5, wherein said second blank member further comprises a second panel portion which folds inward when said first and second side portions of the second blank member are squeezed.

7. The card of claim 6, wherein said first and second panel portion each have a curved end portion.

* * * * *